US012050066B2

(12) United States Patent
Pelletier et al.

(10) Patent No.: US 12,050,066 B2
(45) Date of Patent: Jul. 30, 2024

(54) HEAT EXCHANGER AND AIR-CONDITIONING SYSTEM

(71) Applicant: Danfoss A/S, Nordborg (DK)

(72) Inventors: Pierre Olivier Pelletier, Nordborg (DK); Junfeng Jin, Nordborg (DK)

(73) Assignee: DANFOSS A/S, Nordborg (DK)

( * ) Notice: Subject to any disclaimer, the term of this patent is extended or adjusted under 35 U.S.C. 154(b) by 0 days.

(21) Appl. No.: 18/146,523

(22) Filed: Dec. 27, 2022

(65) Prior Publication Data

US 2023/0137105 A1 May 4, 2023

Related U.S. Application Data

(62) Division of application No. 16/710,079, filed on Dec. 11, 2019, now Pat. No. 11,549,762.

(30) Foreign Application Priority Data

Dec. 14, 2018 (CN) ..... 201811538892.5

(51) Int. Cl.
*F28D 1/04* (2006.01)
*F28F 1/12* (2006.01)
(Continued)

(52) U.S. Cl.
CPC ..... *F28F 1/128* (2013.01); *F28D 1/0426* (2013.01); *F28F 1/14* (2013.01); *F28F 1/24* (2013.01);
(Continued)

(58) Field of Classification Search
CPC ..... F28D 1/0426; F28D 1/0443; F28D 2001/0273
See application file for complete search history.

(56) References Cited

U.S. PATENT DOCUMENTS 11,549,762 B2 1/2023 Pelletier et al.
2003/0178188 A1 9/2003 Coleman
(Continued)

FOREIGN PATENT DOCUMENTS

CN 103644685 A * 3/2014 ..... F28D 1/0426
CN 103644685 A 3/2014
(Continued)

OTHER PUBLICATIONS

English translation of the Notice of the Reason for Refusal corresponding to Japanese Patent App. No. 2019-112513, dated Aug. 8, 2023.
(Continued)

*Primary Examiner* — Eric S Ruppert
(74) *Attorney, Agent, or Firm* — McCormick, Paulding & Huber PLLC

(57) ABSTRACT

Embodiments of the present invention disclose a heat exchanger and an air-conditioning system. The heat exchanger includes heat exchange tubes. The heat exchange tubes have first heat exchange tubes configured to form a first circuit, and second heat exchange tubes configured to form a second circuit. With the heat exchanger and the air-conditioning system according to the embodiments of the present invention, for example, a heat exchange capacity of the heat exchanger in a part load condition is improved.

18 Claims, 11 Drawing Sheets

(51) Int. Cl.

| | |
|---|---|
| ***F28F 1/14*** | (2006.01) |
| ***F28F 1/24*** | (2006.01) |
| ***F28F 9/02*** | (2006.01) |
| *F28D 1/02* | (2006.01) |

(52) U.S. Cl.
CPC ..... *F28F 9/0204* (2013.01); *F28F 9/026* (2013.01); *F28D 2001/0273* (2013.01)

(56) References Cited

U.S. PATENT DOCUMENTS

| | | | | |
|---|---|---|---|---|
| 2013/0126127 | A1 | 5/2013 | Yoshimura et al. | |
| 2015/0086831 | A1 | 3/2015 | Haussmann | |
| 2019/0049194 | A1* | 2/2019 | Yanik | F28F 1/022 |
| 2019/0212063 | A1* | 7/2019 | Mila | F25B 39/02 |

FOREIGN PATENT DOCUMENTS

| | | | | |
|---|---|---|---|---|
| EP | 1867944 | A2 | 12/2007 | |
| JP | H11157326 | A | 6/1999 | |
| JP | 2007333304 | A | 12/2007 | |
| JP | 2008503705 | A | 2/2008 | |
| JP | 2009264686 | A | 11/2009 | |
| JP | 2014126322 | A | 7/2014 | |
| JP | 2018162965 | A | 10/2018 | |
| WO | 2011/134786 | A1 | 11/2011 | |
| WO | 2012017681 | A1 | 2/2012 | |
| WO | WO-2017161939 | A1 * | 9/2017 | F25B 39/02 |
| WO | 2018199782 | A1 | 1/2018 | |
| WO | 2018225919 | A1 | 12/2018 | |

OTHER PUBLICATIONS

English translation of the Notice of the Reason for Refusal corresponding to Japanese Patent App. No. 2019-112512, dated Aug. 1, 2023.

Office Action issued for Mexican Patent Application No. MX/a/2019/008973, dated May 17, 2023 and its general English translation.

* cited by examiner

HEAT EXCHANGER AND AIR-CONDITIONING SYSTEM

CROSS-REFERENCE TO RELATED APPLICATION

This application is a divisional of U.S. patent application Ser. No. 16/710,079, filed Dec. 11, 2019, which claims foreign priority benefits under 35 U.S.C. § 119 to Chinese Patent Application No. 201811538892.5 filed on Dec. 14, 2018, the contents of each of which are hereby incorporated by reference in their entirety.

TECHNICAL FIELD

Embodiments of the present invention relate to a heat exchanger and an air-conditioning system.

BACKGROUND

Heat exchangers for two circuits are separate from each other in a conventional air-conditioning system.

SUMMARY

An object of embodiments of the present invention is to provide a heat exchanger and an air-conditioning system, thereby, for example, improving a heat exchange capacity of the heat exchanger in a part load condition.

Embodiments of the present invention provide a heat exchanger including: heat exchange tubes, wherein the heat exchange tubes include first heat exchange tubes configured to form a first circuit, and second heat exchange tubes configured to form a second circuit.

According to embodiments of the present invention, the heat exchanger further includes: first fins, at least a portion of each of which extends in a first direction, which are arranged in a row in a second direction perpendicular to the first direction, and which are arranged alternately with the heat exchange tubes.

According to embodiments of the present invention, the heat exchanger is bent in an L shape, a U shape, or a C shape when viewed in the second direction.

According to embodiments of the present invention, the heat exchange tube includes a first end on one side of the heat exchanger in the first direction, a second end on the other side of the heat exchanger in the first direction, and an intermediate part between the first end and the second end, the first end of the first heat exchange tube is bent towards a side of the heat exchanger in a third direction perpendicular to both the first direction and the second direction, and the intermediate part and the second end of the first heat exchange tube extend in the first direction, and the second end of the second heat exchange tube is bent towards the side of the heat exchanger in the third direction perpendicular to both the first direction and the second direction, and the intermediate part and the first end of the second heat exchange tube extend in the first direction.

According to embodiments of the present invention, the heat exchanger further includes: two first manifolds which are connected with and are in fluid communication with the first ends and the second ends of the first heat exchange tubes, respectively; and two second manifolds which are connected with and are in fluid communication with the first ends and the second ends of the second heat exchange tubes, respectively.

According to embodiments of the present invention, the heat exchange tube includes a first end and a second end, the heat exchanger further includes: two first manifolds which are connected with and are in fluid communication with the first ends and the second ends of the first heat exchange tubes, respectively; and two second manifolds which are connected with and are in fluid communication with the first ends and the second ends of the second heat exchange tubes, respectively, and one of the first manifold and the second manifold on one side, in the first direction, of the heat exchanger is closer to a center, in the first direction, of the heat exchanger than the other in the first direction, such that at least a portion of the one of the first manifold and the second manifold is located in a region between the other of the first manifold and the second manifold and the first fins in the first direction, to hinder at least a portion of an air stream bypassed through a gap between the other of the first manifold and the second manifold and the first fins.

According to embodiments of the present invention, first heat exchange tube sets each composed of at least one first heat exchange tube, and second heat exchange tube sets each composed of at least one second heat exchange tube are arranged alternately in the second direction.

According to embodiments of the present invention, the first heat exchange tubes, the second heat exchange tubes, and the first fins are aligned, on at least one side in a third direction perpendicular to both the first direction and the second direction, with one another in the second direction.

According to embodiments of the present invention, the first heat exchange tube includes: a first heat exchange tube part and a second heat exchange tube part arranged in a third direction perpendicular to both the first direction and the second direction; and a connection part connecting and fluidly communicating the first heat exchange tube part and the second heat exchange tube part with each other, and the first heat exchange tube part and the second heat exchange tube part are in contact with a same first fin located on one side of the first heat exchange tube part and the second heat exchange tube part in the second direction and are in contact with a same first fin located on the other side of the first heat exchange tube part and the second heat exchange tube part in the second direction.

According to embodiments of the present invention, the heat exchanger further includes: first fins, at least a portion of each of which extends in a first direction, and which are arranged in a row in a second direction perpendicular to the first direction; and second fins, at least a portion of each of which extends in the first direction, and which are arranged in a row in the second direction perpendicular to the first direction, wherein the first heat exchange tube includes: a first heat exchange tube part and a second heat exchange tube part arranged in a third direction perpendicular to both the first direction and the second direction; and a connection part connecting and fluidly communicating the first heat exchange tube part and the second heat exchange tube part with each other, wherein the first fins and a first set of heat exchange tubes composed of both the first heat exchange tube parts of the first heat exchange tubes and the second heat exchange tubes are arranged alternately in a row in the second direction perpendicular to the first direction, and wherein the second fins and a second set of heat exchange tubes composed of the second heat exchange tube parts of the first heat exchange tubes are arranged alternately in a row in the second direction perpendicular to the first direction.

According to embodiments of the present invention, the first heat exchange tube part, the second heat exchange tube part, and the connection part of the first heat exchange tube are formed by bending a single heat exchange tube.

According to embodiments of the present invention, the heat exchange tubes further include third heat exchange tubes configured to form a third circuit, and first heat exchange tube sets each composed of at least one of the first heat exchange tubes, second heat exchange tube sets each composed of at least one of the second heat exchange tubes, and third heat exchange tube sets each composed of at least one of the third heat exchange tubes are arranged alternately in the second direction.

According to embodiments of the present invention, the heat exchanger further includes: first fins, at least a portion of each of which extends in a first direction, and which are arranged in a row in a second direction perpendicular to the first direction; second fins, at least a portion of each of which extends in the first direction, and which are arranged in a row in the second direction perpendicular to the first direction; and third fins, at least a portion of each of which extends in the first direction, and which are arranged in a row in the second direction perpendicular to the first direction, wherein the heat exchange tubes further include third heat exchange tubes configured to form a third circuit, wherein each of the first heat exchange tube and the second heat exchange tube includes: a first heat exchange tube part and a second heat exchange tube part arranged in a third direction perpendicular to both the first direction and the second direction; and a connection part connecting and fluidly communicating the first heat exchange tube part and the second heat exchange tube part with each other, wherein the first heat exchange tube parts of the first heat exchange tubes, the first heat exchange tube parts of the second heat exchange tubes, and the third heat exchange tubes are arranged in a row, the second heat exchange tube parts of the first heat exchange tubes are arranged in a row, the second heat exchange tube parts of the second heat exchange tubes are arranged in a row, and the second heat exchange tube parts of the first heat exchange tubes and the second heat exchange tube parts of the second heat exchange tubes are located on two sides of the third heat exchange tubes in the third direction, respectively, wherein the first fins and a first set of heat exchange tubes composed of the second heat exchange tube parts of the first heat exchange tubes are arranged alternately in a row in the second direction, wherein the second fins and a second set of heat exchange tubes composed of the first heat exchange tube parts of the first heat exchange tubes, the first heat exchange tube parts of the second heat exchange tubes, and the third heat exchange tubes are arranged alternately in a row in the second direction, and wherein the third fins and a third set of heat exchange tubes composed of the second heat exchange tube parts of the second heat exchange tubes are arranged alternately in a row in the second direction.

According to embodiments of the present invention, the heat exchanger further includes: first fins, at least a portion of each of which extends in a first direction, and which are arranged in a row in a second direction perpendicular to the first direction; and second fins, at least a portion of each of which extends in the first direction, and which are arranged in a row in the second direction perpendicular to the first direction, wherein the heat exchange tubes further include third heat exchange tubes configured to form a third circuit, wherein each of the first heat exchange tube and the second heat exchange tube includes: a first heat exchange tube part and a second heat exchange tube part arranged in a third direction perpendicular to both the first direction and the second direction; and a connection part connecting and fluidly communicating the first heat exchange tube part and the second heat exchange tube part with each other, wherein the first heat exchange tube parts of the first heat exchange tubes, the first heat exchange tube parts of the second heat exchange tubes, and the third heat exchange tubes are arranged in a row, and the second heat exchange tube parts of the first heat exchange tubes and the second heat exchange tube parts of the second heat exchange tubes are arranged in a row and are located on a side of the third heat exchange tubes in the third direction, wherein the first fins and a first set of heat exchange tubes composed of the second heat exchange tube parts of the first heat exchange tubes and the second heat exchange tube parts of the second heat exchange tubes are arranged alternately in a row in the second direction, and wherein the second fins and a second set of heat exchange tubes composed of the first heat exchange tube parts of the first heat exchange tubes, the first heat exchange tube parts of the second heat exchange tubes, and the third heat exchange tubes are arranged alternately in a row in the second direction.

According to embodiments of the present invention, in a third direction perpendicular to both the first direction and the second direction, a size of the first fin is the same as a bigger one of a size of a portion of the first heat exchange tube in contact with the first fin and a size of a portion of the second heat exchange tube in contact with the first fin.

According to embodiments of the present invention, the heat exchange tube includes a first end and a second end, the heat exchanger further includes: two first manifolds which are connected with and are in fluid communication with the first ends and the second ends of the first heat exchange tubes, respectively; two second manifolds which are connected with and are in fluid communication with the first ends and the second ends of the second heat exchange tubes, respectively, and two third manifolds which are connected with and are in fluid communication with the first ends and the second ends of the third heat exchange tubes, respectively.

Embodiments of the present invention provide an air-conditioning system including the above heat exchanger.

With the heat exchanger according to the embodiments of the present invention, for example, the heat exchange capacity of the heat exchanger in the part load condition is improved.

DETAILED DESCRIPTION

Figure 1:
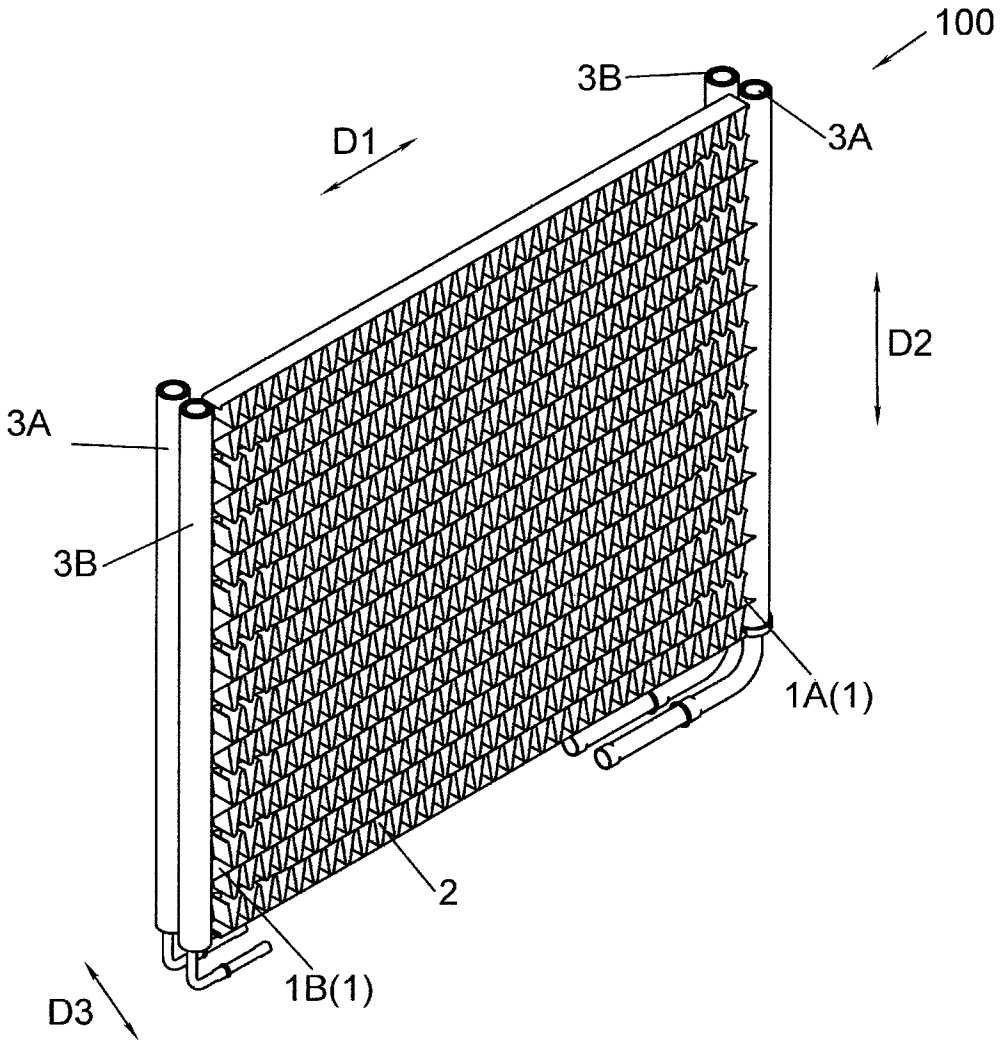
FIG. 1 is a schematic perspective view of a heat exchanger according to a first embodiment of the present invention.

An air-conditioning system according to embodiments of the present invention includes a heat exchanger. Specifically, the air-conditioning system according to the embodiments of the present invention includes a compressor, a heat exchanger as an evaporator, a heat exchanger as a condenser, an expansion valve, and the like. The air-conditioning system may include two or more circuits. Each circuit is constituted by a portion of a heat exchanger configured to form this circuit. A plurality of portions of the heat exchanger respectively configured to form the circuits are connected in parallel and are independent of one another.

Referring to FIGS. 1 to 14, a heat exchanger 100 according to embodiments of the present invention includes heat exchange tubes 1. The heat exchange tubes 1 include first heat exchange tubes 1A configured to form a first circuit, and second heat exchange tubes 1B configured to form a second circuit.

Referring to FIGS. 1 to 3 and 9 to 14, the heat exchanger 100 according to the embodiments of the present invention further includes first fins 2, at least a portion of each of which extends in a first direction D1, which are arranged in a row in a second direction D2 perpendicular to the first direction D1, and which are arranged alternately with the heat exchange tubes 1. Thereby, for example, if one of two circuits of a two-circuit air-conditioning system is turned off, at least some of fins for the one circuit may be used for the other circuit to improve a heat exchange efficiency of the heat exchanger.

Referring to FIGS. 1 to 3 and 9 to 14, the first heat exchange tubes 1A and the second heat exchange tubes 1B are arranged alternately in the second direction D2. In other embodiments of the present invention, first heat exchange tube sets each composed of at least one (one, two, three or more) of the first heat exchange tubes 1A, and second heat exchange tube sets each composed of at least one (one, two, three or more) of the second heat exchange tubes 1B are arranged alternately in the second direction D2. In other words, a plurality of first heat exchange tube sets and a plurality of second heat exchange tube sets are arranged alternately. The heat exchange tube 1 may be a flat tube. According to examples of the present invention, the first heat exchange tubes 1A, the second heat exchange tubes 1B, and the first fins 2 are aligned, on at least one side in a third direction D3 perpendicular to both the first direction D1 and the second direction D2, with one another in the second direction D2. In some examples of the present invention, the first heat exchange tubes 1A include a plurality of first heat exchange tube sets, the second heat exchange tubes 1B include a plurality of second heat exchange tube sets, and the plurality of first heat exchange tube sets and the plurality of second heat exchange tube sets are arranged alternately in the second direction D2. The plurality of first heat exchange tube sets may have the same number or different numbers of first heat exchange tubes 1A. The plurality of second heat exchange tube sets may have the same number or different numbers of second heat exchange tubes 1B.

Referring to FIGS. 1 to 3 and 9 to 14, in some embodiments of the present invention, the first fin 2 has a same size in the third direction D3 perpendicular to both the first direction D1 and the second direction D2 as a bigger one of a portion of the first heat exchange tube 1A in contact with the first fin 2 and a portion of the second heat exchange tube 1B in contact with the first fin 2. Thereby, both the first heat exchange tube 1A and the second heat exchange tube 1B are in contact with the first fin 2 over their entire sizes (for example their entire widths) in the third direction D3.

According to embodiments of the present invention, referring to FIGS. 3 and 9 to 14, the heat exchanger 100 is bent in an L shape (FIGS. 9 and 10), a U shape (FIGS. 3, 13 and 14), or a C shape (FIGS. 11 and 12) when viewed in the second direction D2 (i.e. when viewed in a top view). In addition, the heat exchanger 100 may be bent in any other shape such as a V shape. A heat exchange area may be increased by bending the heat exchanger. The bent heat exchanger is obviously superior in heat exchange capability to a single-row heat exchanger. The number of circuits of the heat exchanger may be greater than or equal to 2.

Figure 2:
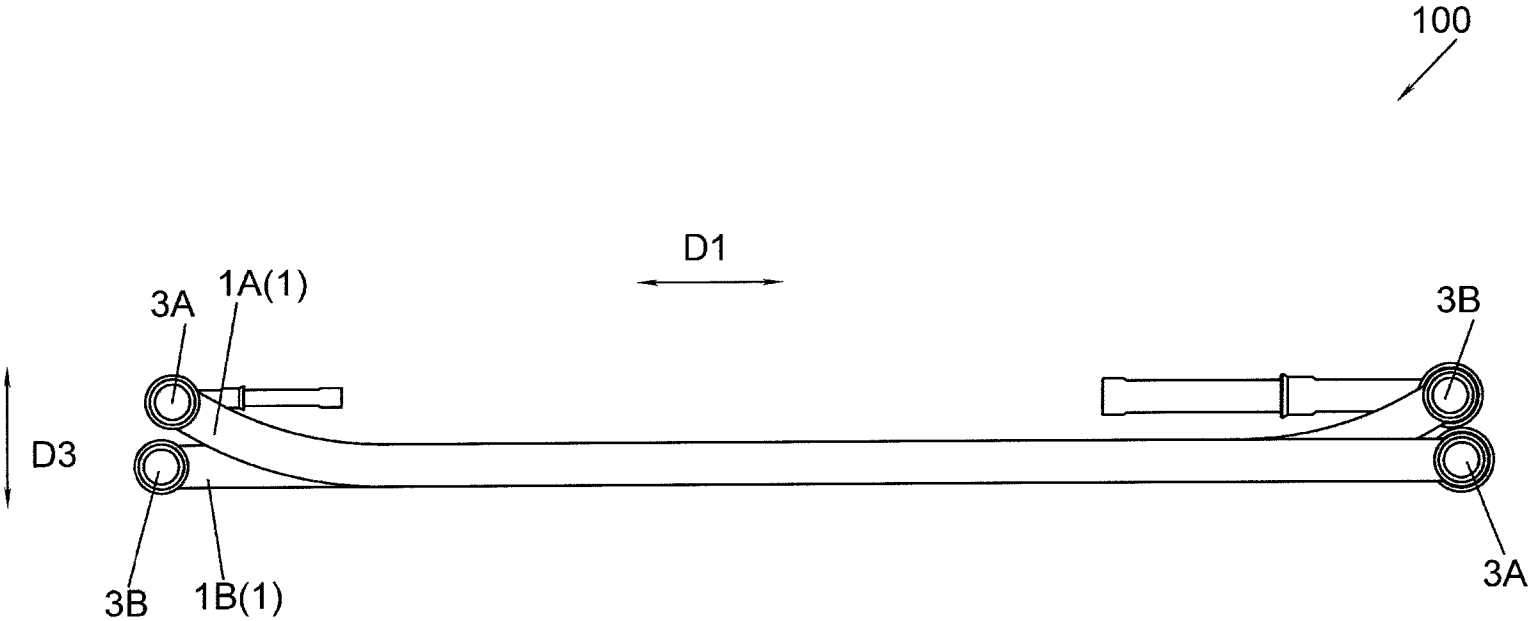
FIG. 2 is a schematic top view of the heat exchanger according to the first embodiment of the present invention.
Figure 3:
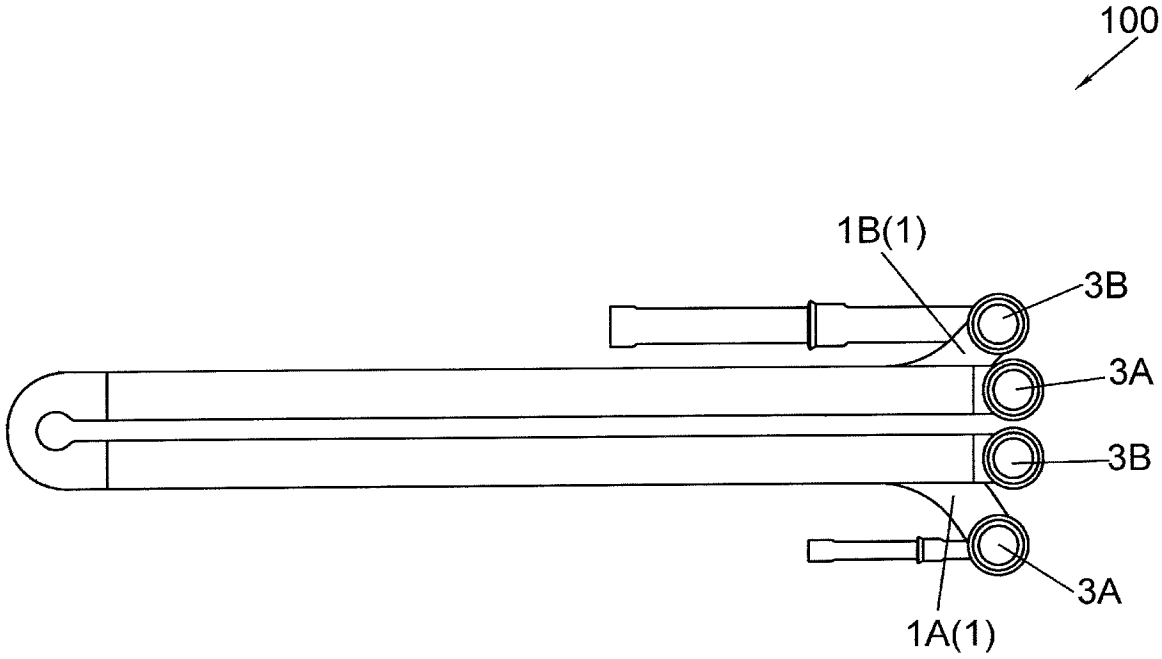
FIG. 3 is a schematic top view of a heat exchanger according to a second embodiment of the present invention.

According to embodiments of the present invention, referring to FIGS. 1 to 3, the heat exchange tube 1 includes a first end 11 on one side of the heat exchanger 100 in the first direction D1, a second end 12 on the other side of the heat exchanger 100 in the first direction D1, and an intermediate part 13 between the first end 11 and the second end 12. The first end 11 of the first heat exchange tube 1A is bent towards a side of the heat exchanger 100 in the third direction D3 perpendicular to both the first direction D1 and the second direction D2, and the intermediate part 13 and the second end 12 of the first heat exchange tube 1A extend in the first direction D1. In addition, the second end 12 of the second heat exchange tube 1B is bent towards the side of the heat exchanger 100 in the third direction D3 perpendicular to both the first direction D1 and the second direction D2, and the intermediate part 13 and the first end 11 of the second heat exchange tube 1B extend in the first direction D1. The heat exchange tube 1 is bent at only one end and not bent in the other end. All the heat exchange tubes 1 may have the same shape and size, so that the number of types of the heat exchange tubes 1 is reduced, thereby remarkably increasing a manufacturing efficiency of the heat exchanger.

According to embodiments of the present invention, referring to FIGS. 1 to 4 and 9 to 14, the heat exchanger 100 further includes: two first manifolds 3A which are connected with and are in fluid communication with the first ends 11 and the second ends 12 of the first heat exchange tubes 1A, respectively; and two second manifolds 3B which are connected with and are in fluid communication with the first ends 11 and the second ends 12 of the second heat exchange tubes 1B, respectively.

Figure 4:
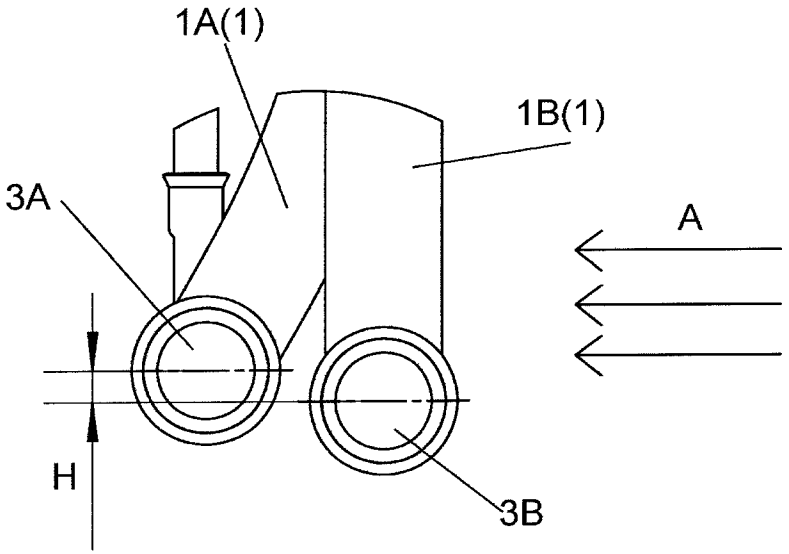
FIG. 4 is a schematic partially enlarged view of a heat exchanger according to a third embodiment of the present invention.

According to embodiments of the present invention, referring to FIGS. 1 to 4 and 9 to 14, the heat exchange tube 1 includes a first end 11 and a second end 12. The heat exchanger 100 further includes: two first manifolds 3A which are connected with and are in fluid communication with the first ends 11 and the second ends 12 of the first heat exchange tubes 1A, respectively; and two second manifolds 3B which are connected with and are in fluid communication with the first ends 11 and the second ends 12 of the second heat exchange tubes 1B, respectively. One of the first manifold 3A and the second manifold 3B on one side, in the first direction D1, of the heat exchanger 100 is closer to a center, in the first direction D1, of the heat exchanger 100 than the other in the first direction D1, such that at least a portion of the one of the first manifold 3A and the second manifold 3B is located in a region between the other of the first manifold 3A and the second manifold 3B and the first fins 2 in the first direction D1, to hinder at least a portion of an air stream A bypassed through a gap between the other of the first manifold 3A and the second manifold 3B and the first fins 2 as shown in FIG. 4. Referring to FIG. 4, a height difference between a center line of the first manifold 3A and a center line of the second manifold 3B is H.

Figure 5:
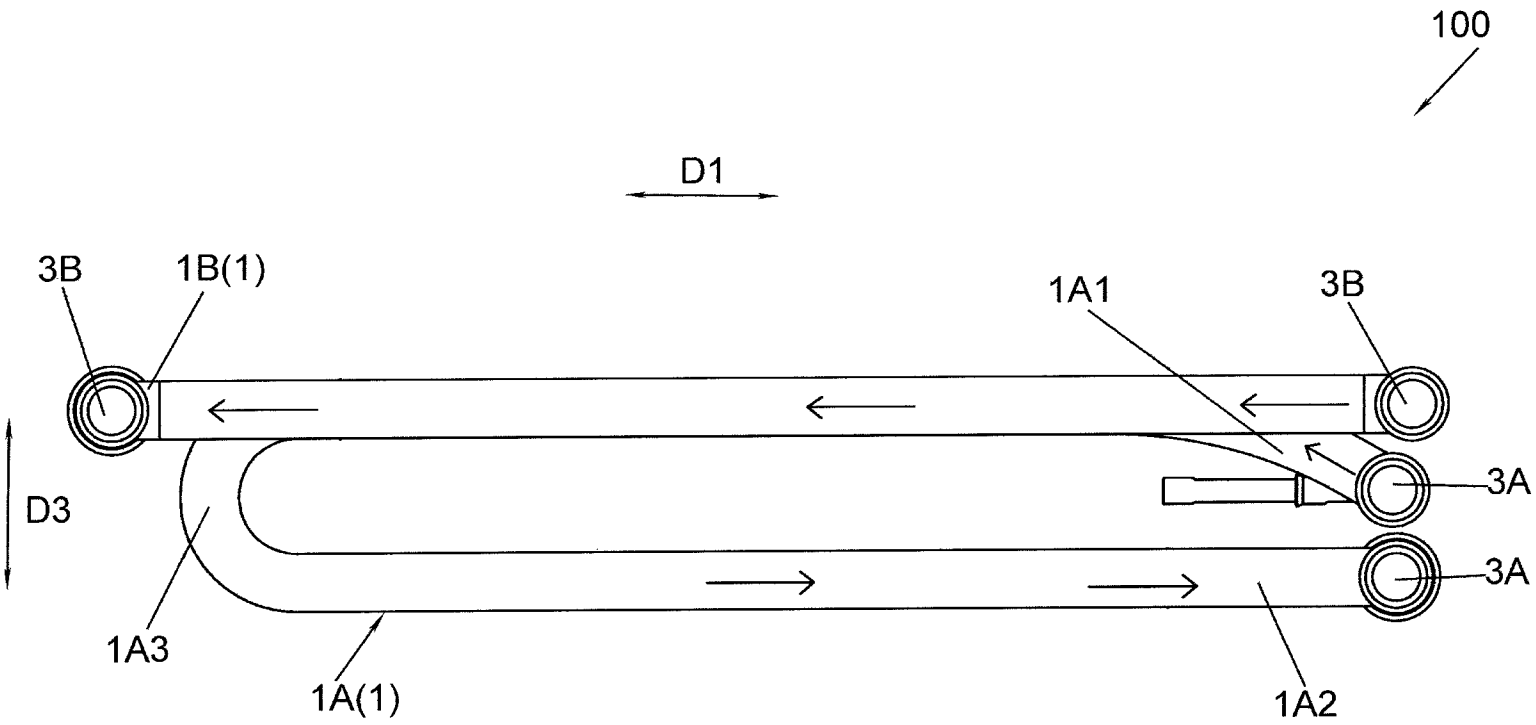
FIG. 5 is a schematic top view of a heat exchanger according to a fourth embodiment of the present invention, in which flow directions of a refrigerant are indicated by arrows along heat exchange tubes.

Referring to FIG. 5, in some embodiments of the present invention, the first heat exchange tube 1A includes: a first heat exchange tube part 1A1 and a second heat exchange tube part 1A2 arranged in the third direction D3 perpendicular to both the first direction D1 and the second direction D2; and a connection part 1A3 connecting and fluidly communicating the first heat exchange tube part 1A1 and the second heat exchange tube part 1A2 with each other. The first heat exchange tube part 1A1 and the second heat exchange tube part 1A2 are in contact with a same first fin 2 located on one side of the first heat exchange tube part 1A1 and the second heat exchange tube part 1A2 in the second direction D2 and are in contact with a same first fin 2 located on the other side of the first heat exchange tube part 1A1 and the second heat exchange tube part 1A2 in the second direction D2. For example, the first heat exchange tube part 1A1, the second heat exchange tube part 1A2, and the connection part 1A3 of the first heat exchange tube 1A are formed by bending a single heat exchange tube 1.

According to the embodiments of the present invention, at least some of the plurality of first fins 2 are shared by the first heat exchange tubes 1A and the second heat exchange tubes 1B. Therefore, if one of two circuits of a two-circuit air-conditioning system is turned off, at least some of the first fins for the one circuit may be used for the other circuit to improve a heat exchange efficiency of the heat exchanger.

Referring to FIG. 5, in some embodiments of the present invention, the heat exchanger 100 further includes: first fins 2, at least a portion of each of which extends in the first direction D1, and which are arranged in a row in the second direction D2 perpendicular to the first direction D1; and second fins, at least a portion of each of which extends in the first direction D1, and which are arranged in a row in the second direction D2 perpendicular to the first direction D1. The first heat exchange tube 1A includes: a first heat exchange tube part 1A1 and a second heat exchange tube part 1A2 arranged in the third direction D3 perpendicular to both the first direction D1 and the second direction D2; and a connection part 1A3 connecting and fluidly communicating the first heat exchange tube part 1A1 and the second heat exchange tube part 1A2 with each other. The first fins 2 and a first set of heat exchange tubes 1 composed of both the first heat exchange tube parts 1A1 of the first heat exchange tubes 1A and the second heat exchange tubes 1B are arranged alternately in a row in the second direction D2 perpendicular to the first direction D1, and the second fins and a second set of heat exchange tubes 1 composed of the second heat exchange tube parts 1A2 of the first heat exchange tubes 1A are arranged alternately in a row in the second direction D2 perpendicular to the first direction D1. A height of the second fin in the second direction D2 is substantially equal to a distance between two adjacent second heat exchange tube parts 1A2, and is greater than a height of the first fin 2 in the second direction D2. In other words, in the present embodiment, the first heat exchange tube 1A has a greater length than the second heat exchange tube 1B, thereby achieving different heat exchange capabilities of different circulation circuits. In addition to the achievement of the different heat exchange capabilities of the different circulation circuits, an installation space for the heat exchanger is sufficiently utilized. The heat exchanger is obviously superior in heat exchange capability to a single-row heat exchanger. The first heat exchange tube parts 1A1 and the second heat exchange tube parts 1A2 may be substantially parallel to one another, and may be substantially parallel to the second heat exchange tubes 1B.

Figure 6:
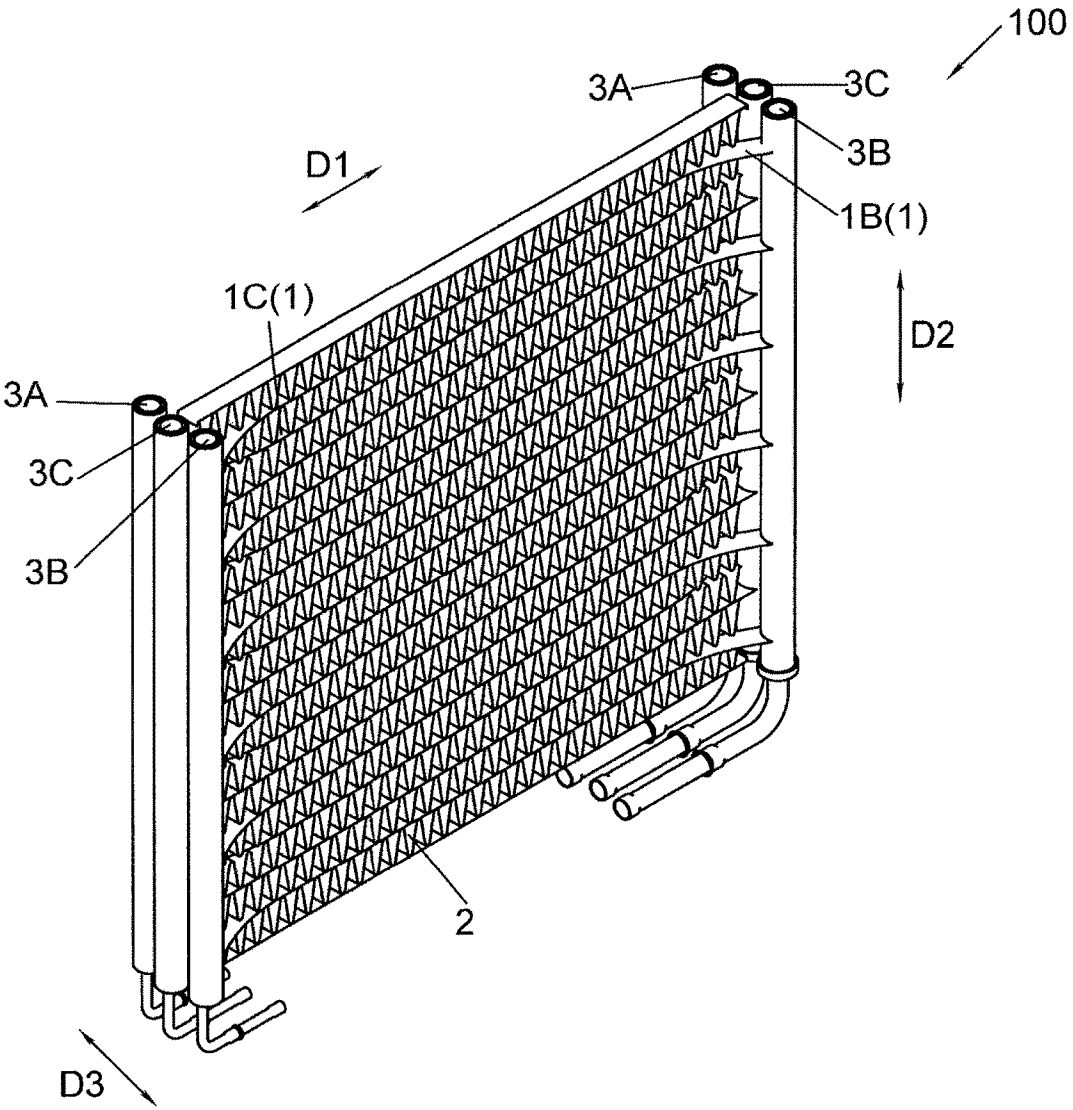
FIG. 6 is a schematic perspective view of a heat exchanger according to a fifth embodiment of the present invention.
Figure 7:
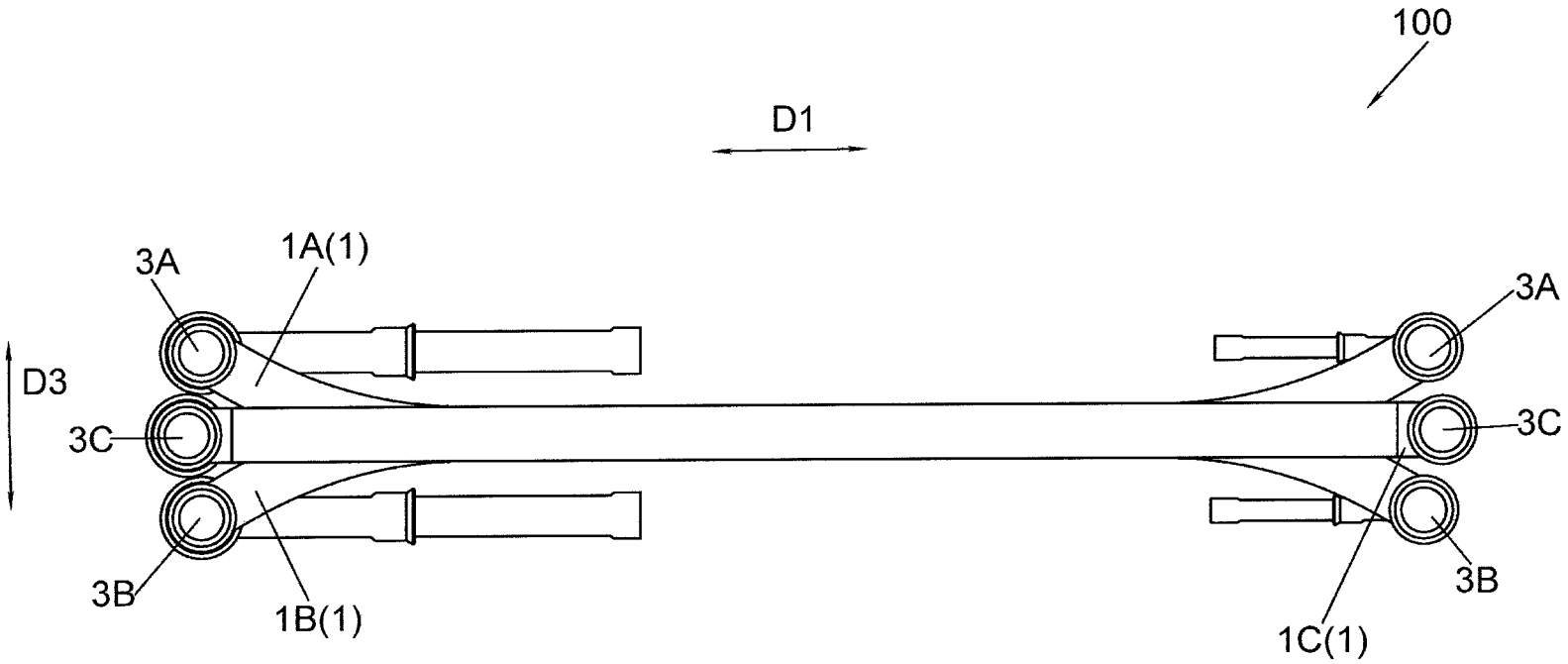
FIG. 7 is a schematic top view of the heat exchanger according to the fifth embodiment of the present invention.
Figure 8:
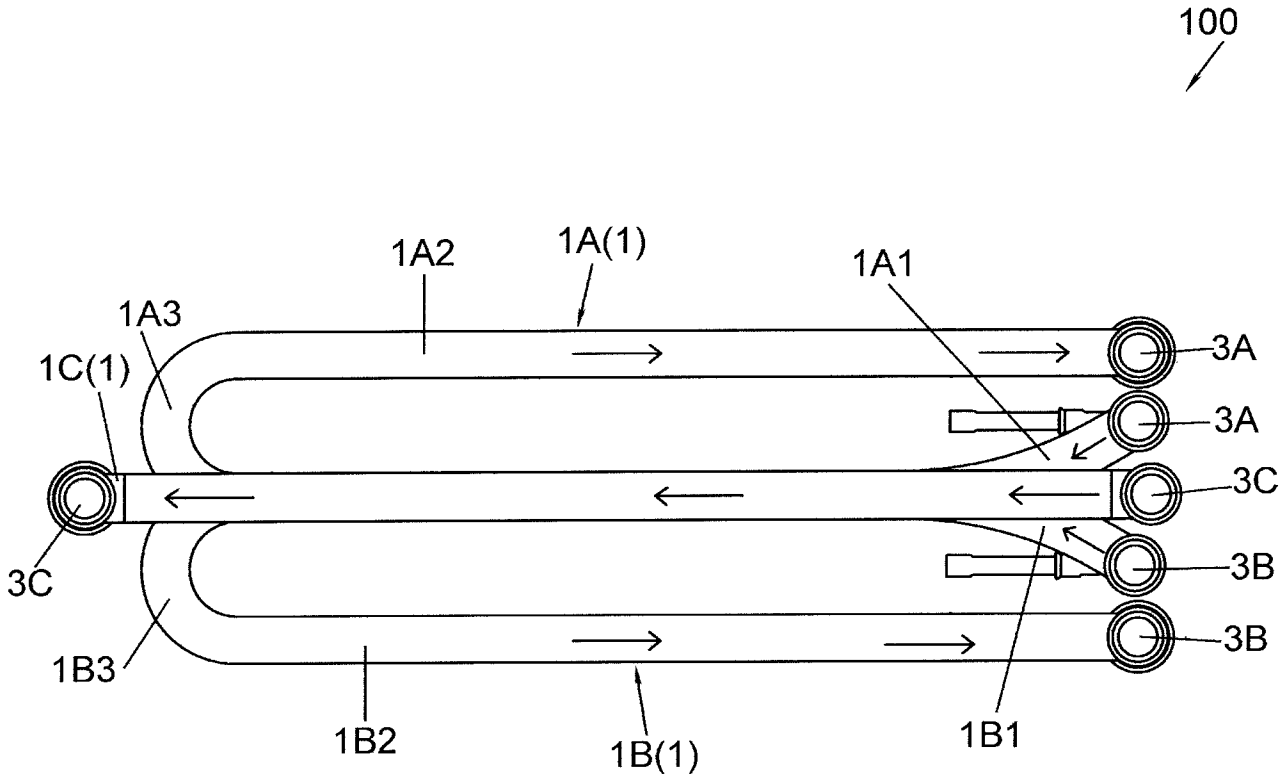
FIG. 8 is a schematic top view of a heat exchanger according to a sixth embodiment of the present invention, in which flow directions of a refrigerant are indicated by arrows along heat exchange tubes.
Figure 10:
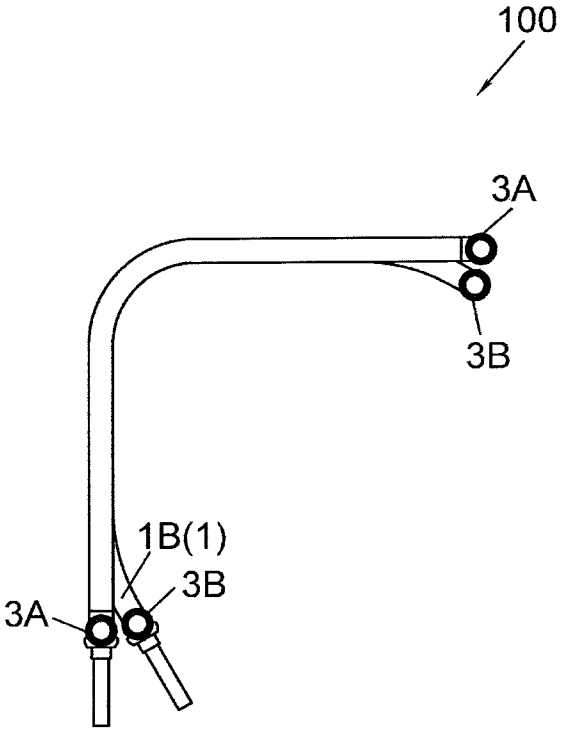
FIG. 10 is a schematic top view of the heat exchanger according to the seventh embodiment of the present invention.
Figure 9:
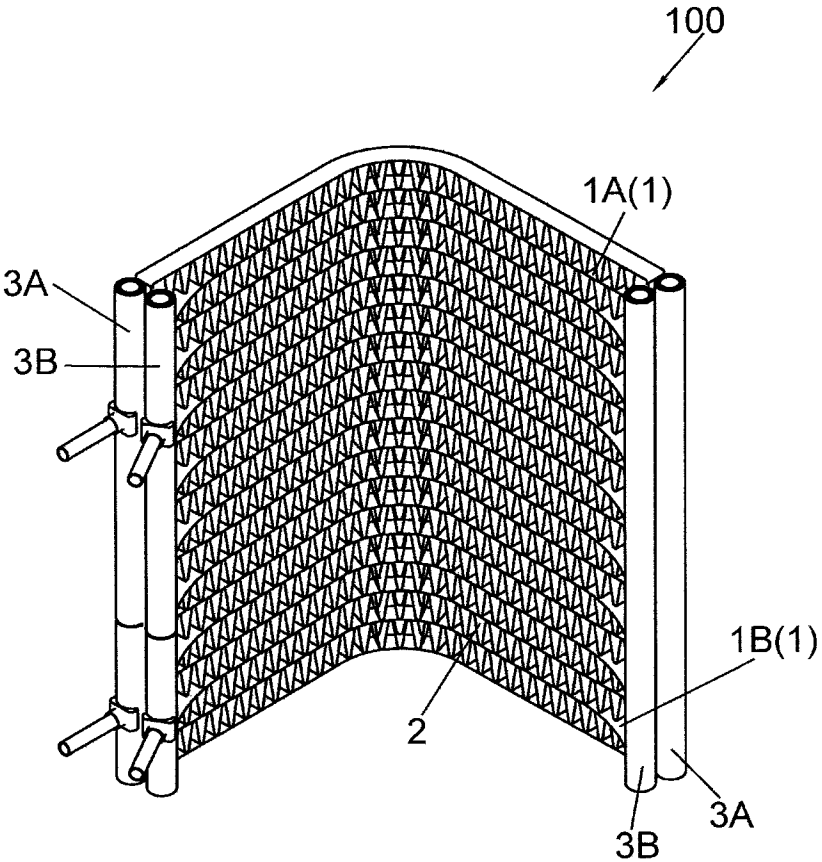
FIG. 9 is a schematic perspective view of a heat exchanger according to a seventh embodiment of the present invention.
Figure 12:
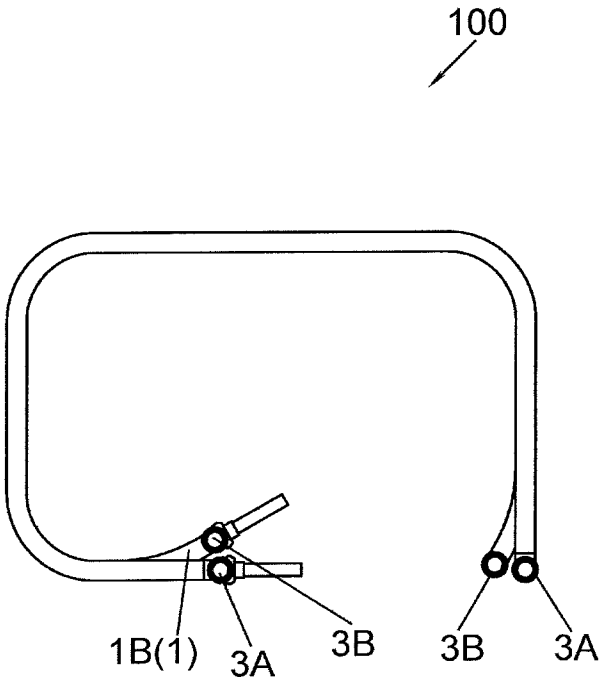
FIG. 12 is a schematic top view of the heat exchanger according to the eighth embodiment of the present invention.
Figure 11:
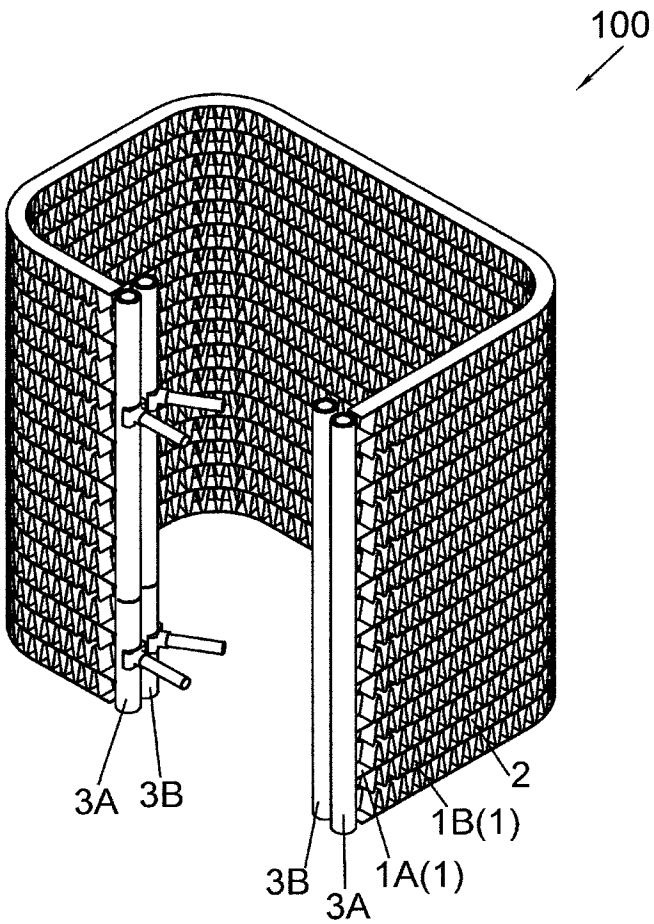
FIG. 11 is a schematic perspective view of a heat exchanger according to an eighth embodiment of the present invention.
Figure 14:
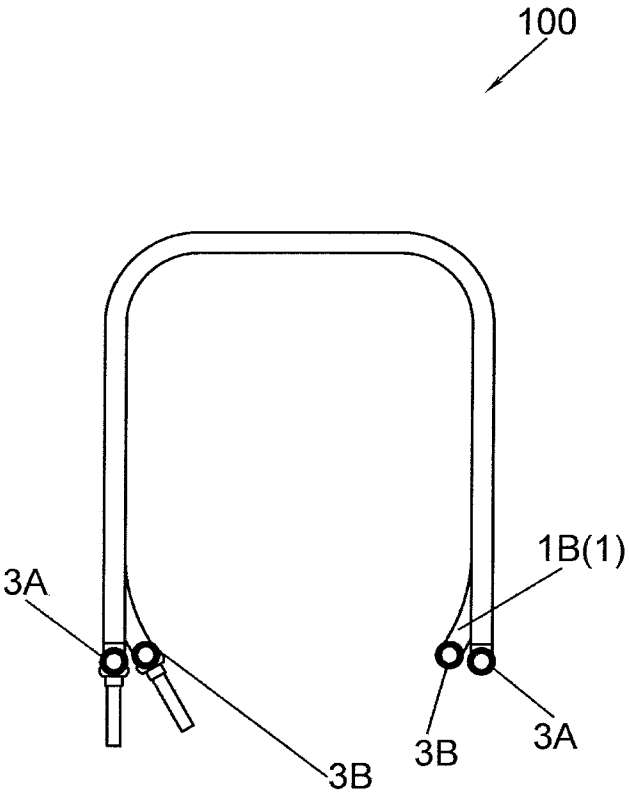
FIG. 14 is a schematic top view of the heat exchanger according to the ninth embodiment of the present invention.
Figure 13:
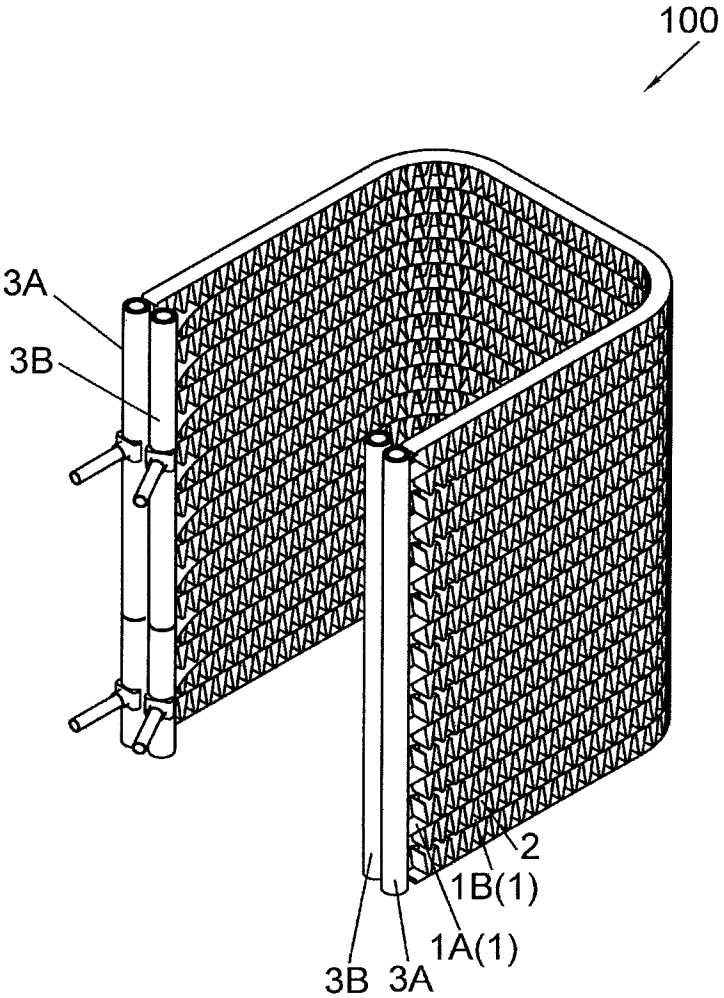
FIG. 13 is a schematic perspective view of a heat exchanger according to a ninth embodiment of the present invention.

Referring to FIG. 8 and referring also to FIGS. 6 and 7, in some embodiments of the present invention, the heat exchange tubes 1 further include third heat exchange tubes 1C configured to form a third circuit. As shown in FIG. 8, the first heat exchange tube 1A includes: a first heat exchange tube part 1A1 and a second heat exchange tube part 1A2 arranged in the third direction D3 perpendicular to both the first direction D1 and the second direction D2; and a connection part 1A3 connecting and fluidly communicating the first heat exchange tube part 1A1 and the second heat exchange tube part 1A2 with each other. As shown in FIG. 8, the second heat exchange tube 1B includes: a first heat exchange tube part 1B1 and a second heat exchange tube part 1B2 arranged in the third direction D3 perpendicular to both the first direction D1 and the second direction D2; and a connection part 1B3 connecting and fluidly communicating the first heat exchange tube part 1B1 and the second heat exchange tube part 1B2 with each other. The first heat exchange tube part 1A1 and the second heat exchange tube part 1A2 of the first heat exchange tube 1A are in contact with a same first fin 2 located on one side of the first heat exchange tube part 1A1 and the second heat exchange tube part 1A2 of the first heat exchange tube 1A in the second direction D2 and are in contact with a same first fin 2 located on the other side of the first heat exchange tube part 1A1 and the second heat exchange tube part 1A2 of the first heat exchange tube 1A in the second direction D2. The first heat exchange tube part 1B1 and the second heat exchange tube part 1B2 of the second heat exchange tube 1B are in contact with a same first fin 2 located on one side of the first heat exchange tube part 1B1 and the second heat exchange tube part 1B2 of the second heat exchange tube 1B in the second direction D2 and are in contact with a same first fin 2 located on the other side of the first heat exchange tube part 1B1 and the second heat exchange tube part 1B2 of the second heat exchange tube 1B in the second direction D2. According to examples of the present invention, the first heat exchange tube parts 1A1 of the first heat exchange tubes 1A, the first heat exchange tube parts 1B1 of the second heat exchange tubes 1B, and the third heat exchange tubes 1C are arranged in a row, the second heat exchange tube parts 1A2 of the first heat exchange tubes 1A are arranged in a row, the second heat exchange tube parts 1B2 of the second heat exchange tubes 1B are arranged in a row, and the second heat exchange tube parts 1A2 of the first heat exchange tubes 1A and the second heat exchange tube parts 1B2 of the second heat exchange tubes 1B are located on two sides of the third heat exchange tubes 1C in the third direction D3, respectively.

Referring to FIG. 8 and referring also to FIGS. 6 and 7, in some embodiments of the present invention, the heat exchanger 100 further includes: first fins 2, at least a portion of each of which extends in the first direction D1, and which are arranged in a row in the second direction D2 perpendicular to the first direction D1; second fins, at least a portion of each of which extends in the first direction D1, and which are arranged in a row in the second direction D2 perpendicular to the first direction D1; and third fins, at least a portion of each of which extends in the first direction D1, and which are arranged in a row in the second direction D2 perpendicular to the first direction D1. The heat exchange tubes 1 further include third heat exchange tubes 1C configured to form a third circuit. The first heat exchange tube 1A includes: a first heat exchange tube part 1A1 and a second heat exchange tube part 1A2 arranged in the third direction D3 perpendicular to both the first direction D1 and the second direction D2; and a connection part 1A3 connecting and fluidly communicating the first heat exchange tube part 1A1 and the second heat exchange tube part 1A2 with each other. The second heat exchange tube 1B includes: a first heat exchange tube part 1B1 and a second heat exchange tube part 1B2 arranged in the third direction D3 perpendicular to both the first direction D1 and the second direction D2; and a connection part 1B3 connecting and fluidly communicating the first heat exchange tube part 1B1 and the second heat exchange tube part 1B2 with each other. The first heat exchange tube parts 1A1 of the first heat exchange tubes 1A, the first heat exchange tube parts 1B1 of the second heat exchange tubes 1B, and the third heat exchange tubes 1C are arranged in a row, the second heat exchange tube parts 1A2 of the first heat exchange tubes 1A are arranged in a row, the second heat exchange tube parts 1B2 of the second heat exchange tubes 1B are arranged in a row, and the second heat exchange tube parts 1A2 of the first heat exchange tubes 1A and the second heat exchange tube parts 1B2 of the second heat exchange tubes 1B are located on two sides of the third heat exchange tubes 1C in the third direction D3, respectively. The first fins 2 and a first set of heat exchange tubes 1 composed of the second heat exchange tube parts 1A2 of the first heat exchange tubes 1A are arranged alternately in a row in the second direction D2. The second fins and a second set of heat exchange tubes 1 composed of the first heat exchange tube parts 1A1 of the first heat exchange tubes 1A, the first heat exchange tube parts 1B1 of the second heat exchange tubes 1B, and the third heat exchange tubes 1C are arranged alternately in a row in the second direction D2. In addition, the third fins and a third set of heat exchange tubes 1 composed of the second heat exchange tube parts 1B2 of the second heat exchange tubes 1B are arranged alternately in a row in the second direction D2.

Referring to FIG. 8 and referring also to FIGS. 6 and 7, in some embodiments of the present invention, the heat exchanger 100 further includes: first fins 2, at least a portion of each of which extends in the first direction D1, and which are arranged in a row in the second direction D2 perpendicular to the first direction D1; and second fins, at least a portion of each of which extends in the first direction D1, and which are arranged in a row in the second direction D2 perpendicular to the first direction D1. The heat exchange tubes 1 further include third heat exchange tubes 1C configured to form a third circuit. The first heat exchange tube 1A includes: a first heat exchange tube part 1A1 and a second heat exchange tube part 1A2 arranged in the third direction D3 perpendicular to both the first direction D1 and the second direction D2; and a connection part 1A3 connecting and fluidly communicating the first heat exchange tube part 1A1 and the second heat exchange tube part 1A2 with each other. The second heat exchange tube 1B includes: a first heat exchange tube part 1B1 and a second heat exchange tube part 1B2 arranged in the third direction D3 perpendicular to both the first direction D1 and the second direction D2; and a connection part 1B3 connecting and fluidly communicating the first heat exchange tube part 1B1 and the second heat exchange tube part 1B2 with each other. The first heat exchange tube parts 1A1 of the first heat exchange tubes 1A, the first heat exchange tube parts 1B1 of the second heat exchange tubes 1B, and the third heat exchange tubes 1C are arranged in a row, and the second heat exchange tube parts 1A2 of the first heat exchange tubes 1A and the second heat exchange tube parts 1B2 of the second heat exchange tubes 1B are arranged in a row and are located on a side of the third heat exchange tubes 1C in the third direction D3. The first fins 2 and a first set of heat exchange tubes 1 composed of the second heat exchange tube parts 1A2 of the first heat exchange tubes 1A and the second heat exchange tube parts 1B2 of the second heat exchange tubes 1B are arranged alternately in a row in the second direction D2. In addition, The second fins and a second set of heat exchange tubes 1 composed of the first heat exchange tube parts 1A1 of the first heat exchange tubes 1A, the first heat exchange tube parts 1B1 of the second heat exchange tubes 1B, and the third heat exchange tubes 1C are arranged alternately in a row in the second direction D2.

Referring to FIGS. 6 to 8, in some embodiments of the present invention, the heat exchange tube 1 includes a first end 11 and a second end 12. the heat exchanger 100 further includes: two first manifolds 3A which are connected with and are in fluid communication with the first ends 11 and the second ends 12 of the first heat exchange tubes 1A, respectively; two second manifolds 3B which are connected with and are in fluid communication with the first ends 11 and the second ends 12 of the second heat exchange tubes 1B, respectively; and two third manifolds 3C which are connected with and are in fluid communication with the first ends 11 and the second ends 12 of the third heat exchange tubes 1C, respectively. According to embodiments of the present invention, the manifolds for one circuit may not be used or may be closed so that the heat exchanger 100 may be applied to a two-circuit system. In addition, an arrangement sequence, in the third direction, of three manifolds of the heat exchanger 100 on a side of the heat exchanger 100 in the first direction may be changed according to requirements.

Referring to FIGS. 6 to 7, in some embodiments of the present invention, the first heat exchange tubes 1A, the second heat exchange tubes 1B, and the third heat exchange tubes 1C are arranged alternately in the second direction D2. In other embodiments of the present invention, first heat exchange tube sets each composed of at least one (one, two, three or more) of the first heat exchange tubes 1A, second heat exchange tube sets each composed of at least one (one, two, three or more) of the second heat exchange tubes 1B, and third heat exchange tube sets each composed of at least one (one, two, three or more) of the third heat exchange tubes 1C are arranged alternately in the second direction D2. In other words, a plurality of first heat exchange tube sets, a plurality of second heat exchange tube sets, and a plurality of third heat exchange tube sets are arranged alternately. The heat exchange tube 1 may be a flat tube. According to examples of the present invention, the first heat exchange tubes 1A, the second heat exchange tubes 1B, the third heat exchange tubes 1C, and the first fins 2 are aligned, on at least one side in the third direction D3 perpendicular to both the first direction D1 and the second direction D2, with one another in the second direction D2. According to examples of the present invention, the first heat exchange tubes 1A, the second heat exchange tubes 1B, the third heat exchange tubes 1C, and the first fins 2 are arranged alternately in a row in the second direction D2, or are arranged in a row in any other way. In some examples of the present invention, the first heat exchange tubes 1A include a plurality of first heat exchange tube sets, the second heat exchange tubes 1B include a plurality of second heat exchange tube sets, the third heat exchange tubes 1C include a plurality of third heat exchange tube sets, and the plurality of first heat exchange tube sets, the plurality of second heat exchange tube sets, and the plurality of third heat exchange tube sets are arranged alternately in the second direction D2. The plurality of first heat exchange tube sets may have the same number or different numbers of first heat exchange tubes 1A. The plurality of second heat exchange tube sets may have the same number or different numbers of second heat exchange tubes 1B. The plurality of third heat exchange tube sets may have the same number or different numbers of third heat exchange tubes 1C.

Referring to FIGS. 6 to 7, in some embodiments of the present invention, the first fin 2 has a same size in the third direction D3 perpendicular to both the first direction D1 and the second direction D2 as a biggest one of a portion of the first heat exchange tube 1A in contact with the first fin 2, a portion of the second heat exchange tube 1B in contact with the first fin 2, and a portion of the third heat exchange tube 1C in contact with the first fin 2. Thereby, all the first heat exchange tube 1A, the second heat exchange tube 1B, and the third heat exchange tube 1C are in contact with the first fin 2 over their entire sizes (for example their entire widths) in the third direction D3.

Referring to FIG. 8 and referring also to FIGS. 6 and 7, in some embodiments of the present invention, different heat exchange capabilities of different circulation circuits may be achieved by changing lengths of the heat exchange tubes 1, while a length of a different heat exchange tube 1 for a different circuit may be achieved by bending a heat exchange tube 1. In addition to the achievement of the different heat exchange capabilities of the different circulation circuits, an installation space for the heat exchanger is sufficiently utilized. The heat exchanger is obviously superior in heat exchange capability to a single-row heat exchanger. The number of the circulation circuits may be greater than or equal to 2. A length of a heat exchange tube 1 for at least one circuit is greater than a length of a heat exchange tube 1 for the other circuit(s), and heat exchange tube parts formed by bending the heat exchange tubes 1 for the at least one circuit are substantially parallel to the other heat exchange tubes 1.

Referring to FIG. 8 and referring also to FIGS. 6 and 7, in some embodiments of the present invention, the first heat exchange tube part, the second heat exchange tube part, and the connection part of the heat exchange tube 1 are formed by bending a single heat exchange tube 1.

According to the embodiments of the present invention, referring to FIGS. 6 to 8, at least some of the plurality of first fins 2 are shared by the first heat exchange tubes 1A, the second heat exchange tubes 1B, and the third heat exchange tubes 1C. Therefore, if one of three circuits of a three-circuit air-conditioning system is turned off, at least some of the first fins for the one circuit may be used for the other two circuits to improve a heat exchange efficiency of the heat exchanger.

According to the embodiments of the present invention, the heat exchange capacity of the heat exchanger in the part load condition is improved, the heat exchanger can maintain an enough flow rate of a refrigerant for returning an oil in the part load condition, and in the case where one circuit fails, the air-conditioning system can continue to operate through another circuit.

According to the embodiments of the present invention, the heat exchanger has more than two circuits, and can be applied to a system having a plurality of completely separate circuits. Each circuit has a separate compressor, and in each circuit, a refrigerant flows independently. The three-circuit heat exchanger can be applied to not only a three-circuit system, and but also a two-circuit system.

In addition, the above embodiments of the present invention may be combined into new embodiments.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A heat exchanger comprising:

heat exchange tubes, first fins, at least a portion of each of which extends in a first direction, which are arranged in a row in a second direction perpendicular to the first direction, and which are arranged alternately with the heat exchange tubes, wherein the heat exchange tubes comprise first heat exchange tubes configured to form a first circuit, and second heat exchange tubes configured to form a second circuit, wherein:

each of the heat exchange tubes comprises a first end and a second end, the heat exchanger further comprises:

two first manifolds which are connected with and are in fluid communication with the first ends and the second ends of the first heat exchange tubes, respectively;

two second manifolds which are connected with and are in fluid communication with the first ends and the second ends of the second heat exchange tubes, respectively, one of the two first manifolds and one of the two second manifolds form one pair of first and second manifolds that at least partially overlap in the first direction such that the one of the two first manifolds is closer to a center of the heat exchanger in the first direction than the one of the two second manifolds, and a second of the two first manifolds and a second of the two second manifolds form another pair that at least partially overlap in the first direction such that the second of the two second manifolds is closer to the center of the heat exchanger in the first direction than the second of the two first manifolds.

2. The heat exchanger of claim 1, wherein:

the heat exchanger is bent in an L shape, a U shape, or a C shape when viewed in the second direction.

3. The heat exchanger of claim 1, wherein:

each of the heat exchange tubes comprises a first end on one side of the heat exchanger in the first direction, a second end on the other side of the heat exchanger in the first direction, and an intermediate part between the first end and the second end, the first end of each of the first heat exchange tubes is bent towards a side of the heat exchanger in a third direction perpendicular to both the first direction and the second direction, and the intermediate part and the second end of each of the first heat exchange tubes extend in the first direction, and the second end of each of the second heat exchange tubes is bent towards the side of the heat exchanger in the third direction perpendicular to both the first direction and the second direction, and the intermediate part and the first end of each of the second heat exchange tubes extend in the first direction.

4. The heat exchanger of claim 1, wherein:

one of the first manifold and the second manifold on one side, in the first direction, of the heat exchanger is closer to a center, in the first direction, of the heat exchanger than the other in the first direction, such that at least a portion of the one of the first manifold and the second manifold is located in a region between the other of the first manifold and the second manifold and the first fins in the first direction, to hinder at least a portion of an air stream bypassed through a gap between the other of the first manifold and the second manifold and the first fins.

5. The heat exchanger of claim 1, wherein:

first heat exchange tube sets each composed of at least one of the first heat exchange tubes, and second heat exchange tube sets each composed of at least one of the second heat exchange tubes are arranged alternately in the second direction.

6. The heat exchanger of claim 1, wherein:

the first heat exchange tubes, the second heat exchange tubes, and the first fins are aligned, on at least one side in a third direction perpendicular to both the first direction and the second direction, with one another in the second direction.

7. The heat exchanger of claim 1, wherein:

the first heat exchange tube comprises: a first heat exchange tube part and a second heat exchange tube part arranged in a third direction perpendicular to both the first direction and the second direction; and a connection part connecting and fluidly communicating the first heat exchange tube part and the second heat exchange tube part with each other, and the first heat exchange tube part and the second heat exchange tube part are in contact with a same first fin located on one side of the first heat exchange tube part and the second heat exchange tube part in the second direction and are in contact with a same first fin located on the other side of the first heat exchange tube part and the second heat exchange tube part in the second direction.

8. The heat exchanger of claim 1, further comprising:

second fins, at least a portion of each of which extends in the first direction, and which are arranged in a row in the second direction perpendicular to the first direction, wherein the first heat exchange tube comprises: a first heat exchange tube part and a second heat exchange tube part arranged in a third direction perpendicular to both the first direction and the second direction; and a connection part connecting and fluidly communicating the first heat exchange tube part and the second heat exchange tube part with each other, wherein the first fins and a first set of heat exchange tubes composed of both the first heat exchange tube parts of the first heat exchange tubes and the second heat exchange tubes are arranged alternately in a row in the second direction perpendicular to the first direction, and wherein the second fins and a second set of heat exchange tubes composed of the second heat exchange tube parts of the first heat exchange tubes are arranged alternately in a row in the second direction perpendicular to the first direction.

9. The heat exchanger of claim 7, wherein:

the first heat exchange tube part, the second heat exchange tube part, and the connection part of the first heat exchange tube are formed by bending a single heat exchange tube.

10. The heat exchanger of claim 1, wherein:

the heat exchange tubes further comprise third heat exchange tubes configured to form a third circuit, and first heat exchange tube sets each composed of at least one of the first heat exchange tubes, second heat exchange tube sets each composed of at least one of the second heat exchange tubes, and third heat exchange tube sets each composed of at least one of the third heat exchange tubes are arranged alternately in the second direction.

11. The heat exchanger of claim 1, further comprising:

second fins, at least a portion of each of which extends in the first direction, and which are arranged in a row in the second direction perpendicular to the first direction; and third fins, at least a portion of each of which extends in the first direction, and which are arranged in a row in the second direction perpendicular to the first direction, wherein the heat exchange tubes further comprise third heat exchange tubes configured to form a third circuit, wherein each of the first heat exchange tube and the second heat exchange tube comprises: a first heat exchange tube part and a second heat exchange tube part arranged in a third direction perpendicular to both the first direction and the second direction; and a connection part connecting and fluidly communicating the first heat exchange tube part and the second heat exchange tube part with each other, wherein the first heat exchange tube parts of the first heat exchange tubes, the first heat exchange tube parts of the second heat exchange tubes, and the third heat exchange tubes are arranged in a row, the second heat exchange tube parts of the first heat exchange tubes are arranged in a row, the second heat exchange tube parts of the second heat exchange tubes are arranged in a row, and the second heat exchange tube parts of the first heat exchange tubes and the second heat exchange tube parts of the second heat exchange tubes are located on two sides of the third heat exchange tubes in the third direction, respectively, wherein the first fins and a first set of heat exchange tubes composed of the second heat exchange tube parts of the first heat exchange tubes are arranged alternately in a row in the second direction, wherein the second fins and a second set of heat exchange tubes composed of the first heat exchange tube parts of the first heat exchange tubes, the first heat exchange tube parts of the second heat exchange tubes, and the third heat exchange tubes are arranged alternately in a row in the second direction, and wherein the third fins and a third set of heat exchange tubes composed of the second heat exchange tube parts of the second heat exchange tubes are arranged alternately in a row in the second direction.

12. The heat exchanger of claim 1, further comprising:

second fins, at least a portion of each of which extends in the first direction, and which are arranged in a row in the second direction perpendicular to the first direction, wherein the heat exchange tubes further comprise third heat exchange tubes configured to form a third circuit, wherein each of the first heat exchange tube and the second heat exchange tube comprises: a first heat exchange tube part and a second heat exchange tube part arranged in a third direction perpendicular to both the first direction and the second direction; and a connection part connecting and fluidly communicating the first heat exchange tube part and the second heat exchange tube part with each other, wherein the first heat exchange tube parts of the first heat exchange tubes, the first heat exchange tube parts of the second heat exchange tubes, and the third heat exchange tubes are arranged in a row, and the second heat exchange tube parts of the first heat exchange tubes and the second heat exchange tube parts of the second heat exchange tubes are arranged in a row and are located on a side of the third heat exchange tubes in the third direction, wherein the first fins and a first set of heat exchange tubes composed of the second heat exchange tube parts of the first heat exchange tubes and the second heat exchange tube parts of the second heat exchange tubes are arranged alternately in a row in the second direction, and wherein the second fins and a second set of heat exchange tubes composed of the first heat exchange tube parts of the first heat exchange tubes, the first heat exchange tube parts of the second heat exchange tubes, and the third heat exchange tubes are arranged alternately in a row in the second direction.

13. The heat exchanger of claim 1, wherein:

each of the first fins has a same size in a third direction perpendicular to both the first direction and the second direction as a bigger one of a portion of the first heat exchange tube in contact with the first a respective fin and a portion of a respective second heat exchange tube in contact with the respective fin.

14. The heat exchanger of claim 10, the heat exchanger further comprises:

two third manifolds which are connected with and are in fluid communication with the first ends and the second ends of the third heat exchange tubes, respectively.

15. An air-conditioning system comprising:

the heat exchanger of claim 1.

16. The heat exchanger of claim 8, wherein:

the first heat exchange tube part, the second heat exchange tube part, and the connection part of the first heat exchange tube are formed by bending a single heat exchange tube.

17. The heat exchanger of claim 11, the heat exchanger further comprises:

two third manifolds which are connected with and are in fluid communication with the first ends and the second ends of the third heat exchange tubes, respectively.

18. The heat exchanger of claim 12, the heat exchanger further comprises:

two third manifolds which are connected with and are in fluid communication with the first ends and the second ends of the third heat exchange tubes, respectively.

* * * * *